US007016636B2

(12) United States Patent
Hayashi et al.

(10) Patent No.: US 7,016,636 B2
(45) Date of Patent: Mar. 21, 2006

(54) DOUBLE-SIDED IMAGE FORMING APPARATUS AND METHOD

(75) Inventors: Takamasa Hayashi, Tokyo (JP); Takeo Ohashi, Kanagawa (JP); Kohichi Kanaya, Kanagawa (JP); Jun Sasaki, Tokyo (JP); Tatsuo Hirono, Kanagawa (JP); Yukio Tagawa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 96 days.

(21) Appl. No.: 10/737,867

(22) Filed: Dec. 18, 2003

(65) Prior Publication Data

US 2004/0170452 A1 Sep. 2, 2004

(30) Foreign Application Priority Data

Dec. 27, 2002 (JP) ..... 2002-380918
Dec. 9, 2003 (JP) ..... 2003-410512

(51) Int. Cl.
*G03G 15/16* (2006.01)
*G03G 15/22* (2006.01)

(52) U.S. Cl. ..... 399/309; 399/306

(58) Field of Classification Search ..... 399/21, 399/82, 298, 299, 302, 306, 308, 309
See application file for complete search history.

(56) References Cited

U.S. PATENT DOCUMENTS 5,124,759 A 6/1992 Fukuchi et al.
5,142,339 A 8/1992 Kasahara et al.
5,144,337 A 9/1992 Imamura et al.
5,146,240 A 9/1992 Hayashi et al.
5,159,392 A 10/1992 Kasahara et al.
5,162,859 A 11/1992 Hirono et al.
5,175,760 A 12/1992 Ohashi et al.
5,208,607 A 5/1993 Ohashi et al.
5,228,669 A 7/1993 Kanaya
5,485,246 A 1/1996 Hayashi et al.
5,510,876 A 4/1996 Hayashi et al.
5,546,164 A 8/1996 Hayashi et al.
5,557,707 A 9/1996 Inoue et al.
5,694,201 A 12/1997 Hayashi et al.

(Continued)

FOREIGN PATENT DOCUMENTS

JP 10-186737 7/1998

*Primary Examiner*—Sandra L. Brase
(74) *Attorney, Agent, or Firm*—Oblon, Spivak, McClelland, Maier & Neustadt, P.C.

(57) ABSTRACT

In a double-sided image forming apparatus and method, back-side images are developed on a first middle transfer belt prior to developing of front-side images on the first middle transfer belt, and the back-side images are transferred to a second middle transfer belt. The number of back-side images allowed to be supported at a time on the second middle transfer belt is determined. The number of back-side images are developed on the first middle transfer belt prior to developing of the same number of front-side images on the first middle transfer belt. The front-side image of the first middle transfer belt and the back-side image of the second middle transfer belt are simultaneously formed on both sides of a copy sheet.

18 Claims, 7 Drawing Sheets

U.S. PATENT DOCUMENTS 5,758,204 A * 5/1998 Haneda et al. ..... 399/309 X
5,784,663 A 7/1998 Hayashi et al.
5,822,666 A * 10/1998 Haneda et al. ..... 399/309
5,920,744 A * 7/1999 Matsubara et al. ..... 399/309 X
5,970,277 A * 10/1999 Shigeta et al. ..... 399/306 X
5,986,684 A 11/1999 Ohashi
5,987,227 A 11/1999 Endo et al.
6,038,410 A * 3/2000 Iriyama ..... 399/309 X
6,172,699 B1 1/2001 Ohashi
6,226,102 B1 5/2001 Koike et al.
6,360,063 B1 * 3/2002 Haneda et al. ..... 399/309 X
2002/0090236 A1 * 7/2002 Omata et al. ..... 399/309

* cited by examiner

DOUBLE-SIDED IMAGE FORMING APPARATUS AND METHOD

BACKGROUND OF THE INVENTION

1. Field of the Invention

The present invention relates to a double-sided image forming apparatus and method in which document images are read, toner images to be printed on the front and back sides of a copy sheet are formed from the read images, and the toner images are transferred and fixed to the front and back sides of the copy sheet so that double-sided image formation is carried out.

2. Description of the Related Art

In an image forming apparatus that performs double-sided image formation, the first page image formed on the photoconductor drum is transferred and fixed to the copy sheet, and it is once contained in the double-sided reversal feeding device. Synchronized with the second page image being formed on the photoconductor drum again, the copy sheet is supplied from the double-sided reversal feeding device, and the second-page image is transferred and fixed to the copy sheet, so that double-sided image formation is carried out.

In the above-mentioned technique, the conveyance of the copy sheet to the double-sided reversal device and the twice fixing of the toner images at the fixing device are needed. It has been pointed out the problem on the reliability of copy-sheet conveyance and the occurrence of paper jam.

In order to cope with this problem, a double-sided image forming apparatus has been developed in which the toner image supporting medium is provided as a middle transfer medium for transferring temporarily the toner image on the photoconductor drum to the toner image supporting medium, and the toner image forming device. This toner image forming device includes the document reader, the image memory which accumulates the read document image, the photoconductor drum, the charging device, the writing unit, the developing device, etc.

In the above-mentioned image forming apparatus, the document is automatically read by the document reader, and the image data of the read document is accumulated in the image memory. By reading the image data of the second page from the image memory, the image formation on the photoconductor drum is performed. The image on the photoconductor drum is transferred to the toner image supporting medium. After this, the image data of the first page is read from the image memory, and the image formation on the photoconductor drum is performed. And the synchronization of the paper feeding, the toner image supporting medium, and the photoconductor drum is taken, the images of the first page and the second page are transferred to both sides of the copy sheet, respectively, so that double-sided printing is carried out.

Moreover, when the first-page document is manually placed on the contact glass (document stand) of the digital copier, the CPU determines whether the document size is less than A4 size according to an output signal of the document size detector. When it is A4 size or less, the two-sheet mode is chosen in the above-mentioned image forming apparatus. The front-side image of the first sheet is stored in the image memory, the front-side image is formed with the toner, and the toner image is transferred to the toner image supporting medium. Next, the front-side image of the second sheet is formed with the toner, and the toner image is transferred to the toner image supporting medium.

Namely, the toner images for the front-side images of the first and second sheets are formed on the toner image supporting medium in the two-sheet mode. Next, the toner image supporting medium is separated from the photoconductor drum, the back-side image of the second sheet is read, and the image data is stored in the image memory. And by reading the image data from the image memory, the back-side images of the two sheets are formed on the photoconductor drum, and the paper feeding of the copy sheets is started. And the back-side images are transferred from the photoconductor drum to the copy sheets in a consecutive manner.

Next, the front-side images are transferred from the toner image supporting medium to the copy sheets, and the copy sheets with the double-sided printed images are passed through the fixing device, and the paper ejection is performed. See Japanese Laid-Open Patent Application No. 10-186737 for the above-described technique.

However, in the above-mentioned image forming apparatus, the sequence of reading of respective document images and the sequence of developing/transferring of the toner images are not taken into consideration, and a relatively long time is needed for double-sided printing of a first copy sheet among a plurality of copy sheets. In other words, the first copy time is relatively long. This is not convenient for the user of the image forming apparatus, and the user feels the waiting in a long time to obtain the first copy sheet. For this reason, the user-friendliness of the image forming apparatus deteriorates.

Moreover, when a paper jam occurs within the first copy time, the double-sided printing speed of the image forming apparatus as a whole is significantly lowered due to the paper jam.

SUMMARY OF THE INVENTION

An object of the present invention is to provide an improved double-sided image forming apparatus and method in which the above-described problems are eliminated.

Another object of the present invention is to provide a double-sided image forming apparatus that minimizes the double-sided printing time as a whole by preventing the printing delay at the early stage of double-sided image formation.

Another object of the present invention is to provide a double-sided image forming method that minimizes the double-sided printing time as a whole by preventing the printing delay at the early stage of double-sided image formation.

The above-mentioned objects of the present invention are achieved by a double-sided image forming apparatus which forms a first image supported by a first image supporting medium and a second image supported by a second image supporting medium on both sides of a copy sheet simultaneously, the apparatus comprising: a first unit performing developing of the first image and the second image on the first image supporting medium; a second unit performing transferring of the developed second image to the second image supporting medium; and a third unit controlling the developing of the second image on the first image supporting medium to be performed earlier than the developing of the first image on the first image supporting medium.

The above-mentioned objects of the present invention are achieved by a double-sided image forming apparatus which forms a first image supported by a first image supporting medium and a second image supported by a second image supporting medium on both sides of each of a plurality of copy sheets by reading the first image and the second image from a plurality of documents sequentially, the apparatus comprising: a first unit performing developing of the first image and the second image on the first image supporting medium; a second unit performing transferring of the developed second image from the first image supporting medium to the second image supporting medium; a third unit performing continuously double-sided image formation for second and subsequent copy sheets among the plurality of copy sheets in which the developed first image of the first image supporting medium and the developed second image of the second image supporting medium are transferred to both sides of each copy sheet after a start of the reading of the second image of a following copy sheet; and a fourth unit performing, only for a first copy sheet, the double-sided image formation earlier than the start of the reading of the second image of a following copy sheet.

The above-mentioned objects of the present invention are achieved by a double-sided image forming method which forms a first image supported by a first image supporting medium and a second image supported by a second image supporting medium on both sides of a copy sheet simultaneously in an image forming apparatus, the method comprising steps of: developing the first image and the second image on the first image supporting medium; transferring the developed second image to the second image supporting medium; and controlling the developing of the second image on the first image supporting medium to be performed earlier than the developing of the first image on the first image supporting medium.

The above-mentioned objects of the present invention are achieved by a double-sided image forming method which forms a first image supported by a first image supporting medium and a second image supported by a second image supporting medium on both sides of each of a plurality of copy sheets in an image forming apparatus by reading the first image and the second image from a plurality of documents sequentially, the method comprising steps of: developing the first image and the second image on the first image supporting medium; transferring the developed second image from the first image supporting medium to the second image supporting medium; performing continuously double-sided image formation for second and subsequent copy sheets among the plurality of copy sheets in which the developed first image of the first image supporting medium and the developed second image of the second image supporting medium are transferred to both sides of each copy sheet after a start of the reading of the second image of a following copy sheet; and performing, only for a first copy sheet, the double-sided image formation earlier than the start of the reading of the second image of a following copy sheet.

According to the double-sided image forming apparatus and method of the present invention, it is possible to prevent the printing delay at the early stage of double-sided image formation. When the document size is specified, the double-sided printing for a plurality of documents can be performed speedily. When the document reading takes a long time, the continuation double-sided printing is started from the time the reading of the documents of a predetermined number is completed. It is possible to improve the time for the double-sided image formation as a whole. It is possible for the present invention to provide a double-sided image forming apparatus and method that carries out the double-sided printing with a short first copy time, and provide the user with good user-friendliness.

BRIEF DESCRIPTION OF THE DRAWINGS

Other objects, features and advantages of the present invention will be apparent from the following detailed description when reading in conjunction with the accompanying drawings.

DETAILED DESCRIPTION OF PREFERRED EMBODIMENTS

A description will now be given of the preferred embodiments of the invention with reference to the accompanying drawings.

Figure 1:
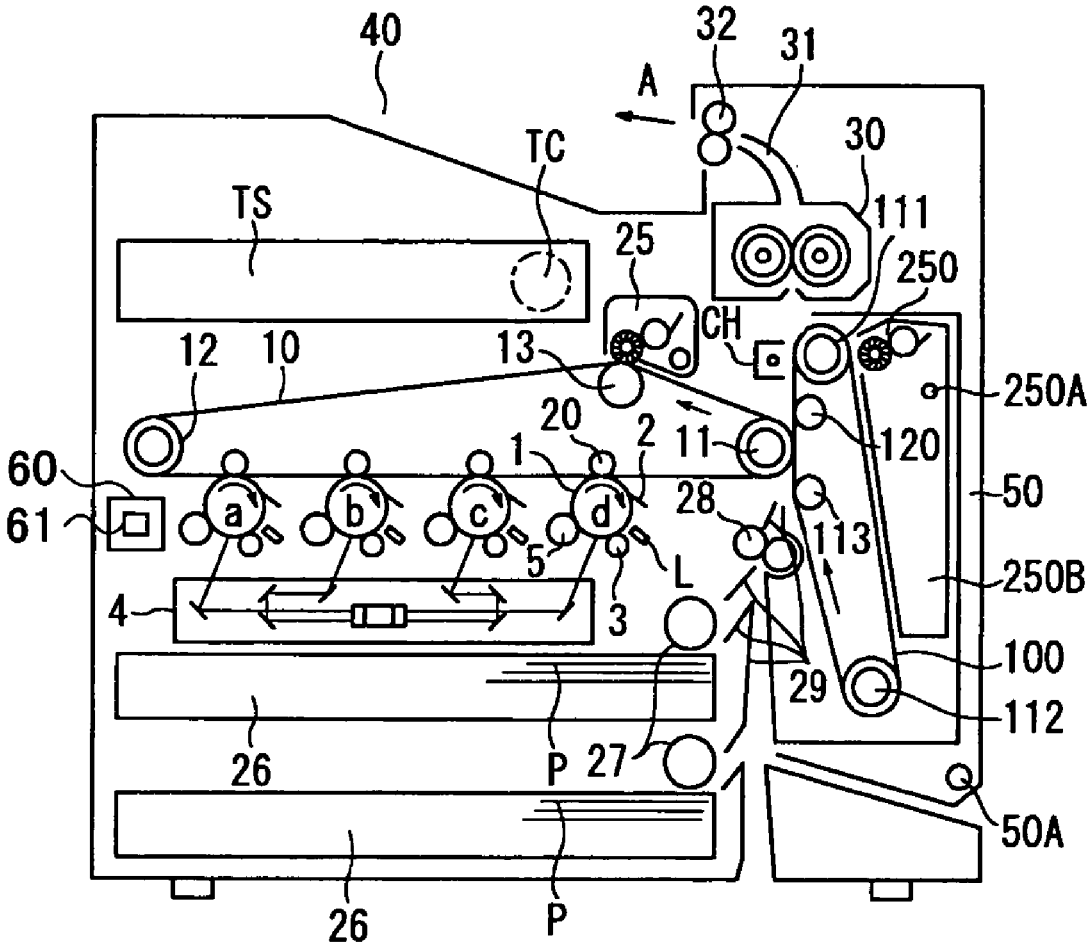
FIG. 1 is a cross-sectional view of a central part of a double-side digital copier to which an embodiment of the invention is applied.

FIG. 1 shows a central part of a double-side digital copier to which one embodiment of the present invention is applied.

As shown in FIG. 1, the photoconductor drum 1 is provided which is supported so as to be rotatable in the direction of the arrow (clockwise direction), and the cleaning device 2, the electric discharger L, the charging device 3, and the developing device 5 are provided around the periphery of the photoconductor drum 1.

There is provided the space between the charging device 3 and the developing device 5. In the space, the light beam irradiated from the exposure device 4 according to image information is incident to the surface of the photoconductor drum 1.

The double-side digital copier is provided with the four photoconductor drums 1 that are indicated by a, b, c, d in FIG. 1, and the cleaning devices 2, the electric dischargers L, the charging devices 3, and the developing devices 5, which are provided around the periphery of each photoconductor drum 1, are essentially the same as those corresponding elements described above. However, the colors of the coloring material (toner) contained in the developing devices 5 of the respective photoconductor drums 1 are different from each other.

Each photoconductor drum 1 is provided from the aluminum cylinder having a diameter in a range from 30 mm to 100 mm, and the layer of the organic semiconductor, which is the photoconductivity substance, is formed on the aluminum cylinder surface. Part of each photoconductor drum 1 is in contact with the first middle transfer belt 10 which is provided as a first image supporting medium.

Alternatively, the belt-like photoconductor medium may be used instead of the photoconductor drum 1.

The first middle transfer belt 10 is supported and tension is applied thereto by the rotation rollers 11, 12, and 13, and the first middle transfer belt 10 is moved in the direction of the arrow (counterclockwise direction).

The first transferring device 20 is respectively provided adjacent to the position of each photoconductor drum 1 on the back side (the inner side of the belt loop) of the first middle transfer belt 10. Moreover, the cleaning device 25 for the first middle transfer belt 10 is provided on the front side (the outside of the belt loop) of the first middle transfer belt 10.

The cleaning device 25 wipes away the unnecessary toner which remains on the surface of the first middle transfer belt 10 after a toner image is transferred from the first middle transfer belt 10 to the second middle transfer belt 100 which will be described later.

The exposure device 4 forms the electrostatic latent image on the photoconductor surface by irradiating the laser beam corresponding to the full color image formation, to the uniformly charged photoconductor surface by using the known laser method.

Alternatively, the exposure device which is provided with the LED array and the imaging device may be also used instead.

The first middle transfer belt 10 is the belt which is composed of the base having a thickness in a range from 50 micrometers to 600 micrometers, and the base is made of a resin film or rubber and has an adequate resistance to enables the transfer of toner particles from the photoconductor drum 1 to the first middle transfer belt 10.

The second middle transfer belt 100 which is provided as a second image supporting medium is arranged on the right side of the portion of the first middle transfer belt 10 where the belt 10 is supported by the rotation roller 11.

The second middle transfer belt 100 is supported and tension is applied thereto by the rotation rollers 111, 112 and 113, and the second middle transfer belt 100 is moved in the direction of the arrow (clockwise direction).

The second transfer device 120 is provided on the back side (the inner side of the belt loop) of the second middle transfer belt 100. The cleaning device 250 and the charging device CH for the second middle transfer belt 100 are provided on the front side (the outside of the belt loop) of the second middle transfer belt 100. The cleaning device 250 wipes away the unnecessary toner which remains after a toner image is transferred from the second middle transfer belt 100 to a copy sheet.

With the transfer device 120, the rotation roller 113, and the rotation roller 11 that supports the first middle transfer belt 10, the second middle transfer belt 100 is in contact with the first middle transfer belt 10, and a predetermined transfer nip is defined between the first middle transfer belt 10 and the second middle transfer belt 100.

The second middle transfer belt 100 is the belt which is composed of the base having a thickness in a range from 50 micrometers to 600 micrometers, and the base is made of a resin film or rubber and has an adequate resistance to enable the transfer of toner particles from the first middle transfer belt 10 to the second middle transfer belt 100.

The paper feeding devices (paper cassettes) 26 are provided in the lower part of the digital copier, and the copy sheet P on the top of copy sheets contained in each paper feeding device is supplied one by one to the guides 29 by means of the feed roller 27. The copy sheet P is further transported to the resist roller pair 28 through the guides 29.

In the upper part of the digital copier, the fixing device 30, the ejection guide pair 31, the ejection roller pair 32 and the ejection stack section 40 are provided.

The toner compartment TS which can contain the replenishing toner is provided above the first middle transfer belt 10 and under the ejection stack section 40.

The colors of the toner are the four colors of magenta, cyan, yellow and black, and such toners are contained in the form of the cartridge TC. By using the toner particle pump (not shown in FIG. 1), the corresponding one of the color toners in the toner compartment TS is supplied to the developing device 5 of the corresponding photoconductor drum 1.

The frame 50 which is provided as the part of the digital copier body is configured into the retractable structure which enables rotation and opening of the frame 50 around the central axis of the pivot 50A. The transport passage of the copy sheet P can be opened widely, which makes it possible to easily remove the copy sheet, which is subjected to a paper jam, from the inside of the frame 50.

Moreover, in the digital copier of FIG. 1, the control unit 60 which controls operation of the respective devices of the double-side digital copier described above is provided, and the control unit 60 includes the CPU 61 which executes control of the double-sided image formation.

Next, a description will be given of the double-sided copy operation of the above-mentioned double-side digital copier.

At first, the imaging on the photoconductor drum 1 is performed. That is, the laser beam from the LD light source (not shown in FIG. 1) is passed through the optical system (not shown), and it is incident to the surface of the photoconductor drum 1 by the operation of the exposure device 4. The photoconductor drum surface is uniformly charged by the charging device 3. The laser beam is incident to the photoconductor drum 1, indicated by "a" in FIG. 1, among the photoconductor drums 1, and the electrostatic latent image corresponding to the writing image information (according to the color) is formed thereon.

The latent image on the photoconductor drum 1 is developed with the toner by the developing device 5, and the toner image is formed and held on the surface of the photoconductor drum 1. This toner image is transferred to the surface of the first middle transfer belt 10 by the first transferring device 20. The first middle transfer belt 10 is moved synchronized with the rotation of the photoconductor drum 1.

Then, the unnecessary toner which remains on the surface of the photoconductor drum 1 is cleaned by the cleaning device 2. The surface of the photoconductor drum 1 is discharged by the electric discharger L, and placed in a waiting condition for the following imaging cycle.

The first middle transfer belt 10 supports the toner image transferred to the surface thereof, and is moved in the direction of the arrow in FIG. 1.

The latent image corresponding to another color is written in the surface of the photoconductor drum 1 indicated by b in FIG. 1, and the latent image is developed with the toner of the corresponding color, so that the toner image is formed on the photoconductor drum surface. This toner image is overlapped over the first image supporting medium (the first middle transfer belt 10) to which the toner image of the previous color is already transferred. The same procedures are repeated for the photoconductor drums 1 indicated by c and d in FIG. 1. A total of the toner images of the four colors are formed on the first middle transfer belt 10 in order to carry out the full color image formation.

Synchronized with this time, the second middle transfer belt 100 is moved in the direction of the arrow, and the toner image is transferred to the surface of the second middle transfer belt 100 from the surface of the first middle transfer belt 10 by the second transfer device 120.

The above-described transfer method is called the tandem transfer method. In the tandem transfer method, while the toner images are formed on the four photoconductor drums 1, the first and second middle transfer belts 10 and 100 are moved, so that imaging is carried out. Therefore, the time for the imaging can be shortened.

When the first middle transfer belt 10 is moved to a predetermined position, the toner image to be formed on the opposite side of the copy sheet is formed on the photoconductor drum 1 in the same manner as mentioned above. At this time, the paper feeding of the copy sheet is started.

When the feed roller 27 is rotated counterclockwise, the copy sheet P on the top of the plurality of copy sheets contained in the paper cassette 26 is pulled out, and it is transported to the resist roller pair 28. When the copy sheet P passes the resist roller pair 28, it is transported through the passage between the first middle transfer belt 10 and the second middle transfer belt 100. The toner image on the surface of the first middle transfer belt 10 is transferred to one side of the copy sheet by the second transfer device 120.

The copy sheet is conveyed further up and the toner image on the surface of the second middle transfer belt 100 is transferred to the other side of the copy sheet by the charging device CH. On the occasion of the image transferring, the timing of the transport of the copy sheet is adjusted so that the positions of the images become correct.

In the present embodiment, the polarity of the toner formed on the photoconductor drum 1 is minus (negative). The toner formed on the photoconductor drum 1 is transferred to the first middle transfer belt 10 by giving the plus charge to the first transferring device 20.

Moreover, the toner formed on the first middle transfer belt 10 is transferred to the second middle transfer belt 100 by giving the plus charge to the second transfer device 120. Furthermore, the toner on the surface of the first middle transfer belt 10 is also transferred to one side of the copy sheet.

Since the charging device CH applies the plus charge to the copy sheet, the toner of minus polarity on the surface of the second middle transfer belt 100 is attracted, and the toner is transferred to the other side of the copy sheet.

In the above-described operation, the copy sheet P with the toner images transferred to the both sides of the copy sheet is conveyed to the fixing device 30, the toner images on the both sides of the copy sheet are heated at once so that the fixing of the toner to the copy sheet is attained. The copy sheet is then transported through the guide pair 31 to the ejection stack section 40 on the top of the main frame by the ejection roller pair 32.

In the present embodiment, the copy sheet is placed on the ejection stack section 40 so that the first image transferred to the copy sheet earlier becomes the up side of the copy sheet on the ejection stack section 40 and the second image transferred to the copy sheet later becomes the down side of the copy sheet on the ejection stack section 40. Hence, to fit the order of the pages, the imaging of the second page is performed earlier and the corresponding toner image is retained on the second middle transfer belt 100. The toner image of the first page is transferred from the first middle transfer belt 10 directly to the copy sheet.

The image transferred to the copy sheet from the first middle transfer belt 10 is obtained by forming the upright image on the surface of the photoconductor drum 1 in a first exposure process, and the image transferred to the copy sheet from the second middle transfer belt 100 is obtained by forming the inverted image on the surface of the photoconductor drum 1 in a second exposure process.

The order of imaging for such page matching can be realized by using the known technology in which the image data is held in the image memory. The switching of the first exposure process to form the upright image and the second exposure process to form the inverted image can also be realized by using the known image-processing technology.

The cleaning device 250 is equipped with the known brush roller, the collection roller, the blade, etc. After transferring of the toner image from the second middle transfer belt 100 to the copy sheet, the cleaning device 250 acts to remove the unnecessary toner and the unnecessary paper chips which remain on the surface of the second middle transfer belt 100.

The cleaning device 250 is supported to be rotatable around the supporting-point 250A. The cleaning device 250 is constituted so that the separation of the brush roller from the surface of the second middle transfer belt 100 is possible.

When the second middle transfer belt 100 supports the toner image prior to the transferring of the toner image to the copy sheet, the brush roller is separated from the surface of the second middle transfer belt 100. When the cleaning is needed, the brush roller is rotated counterclockwise in FIG. 1 and made to contact the surface of the second middle transfer belt 100. The removed toner is collected into the toner compartment 250B by the collection roller of the cleaning device 250.

In the double-sided copy operation of the digital copier described above, it is possible to transfer a plurality of document images (for example, two images) to the second middle transfer belt 100 at a time according to the specified document size. In such a case, the image reading speed of the document reader is different from the speed of printing operation of the printing device, and in a series of printing operations, the productivity of image formation as a whole will deteriorate.

A description will be given as to how a printing delay arises at the early stage of double-sided image formation, and as to how the printing delay is minimized according to the present invention.

Figure 2:
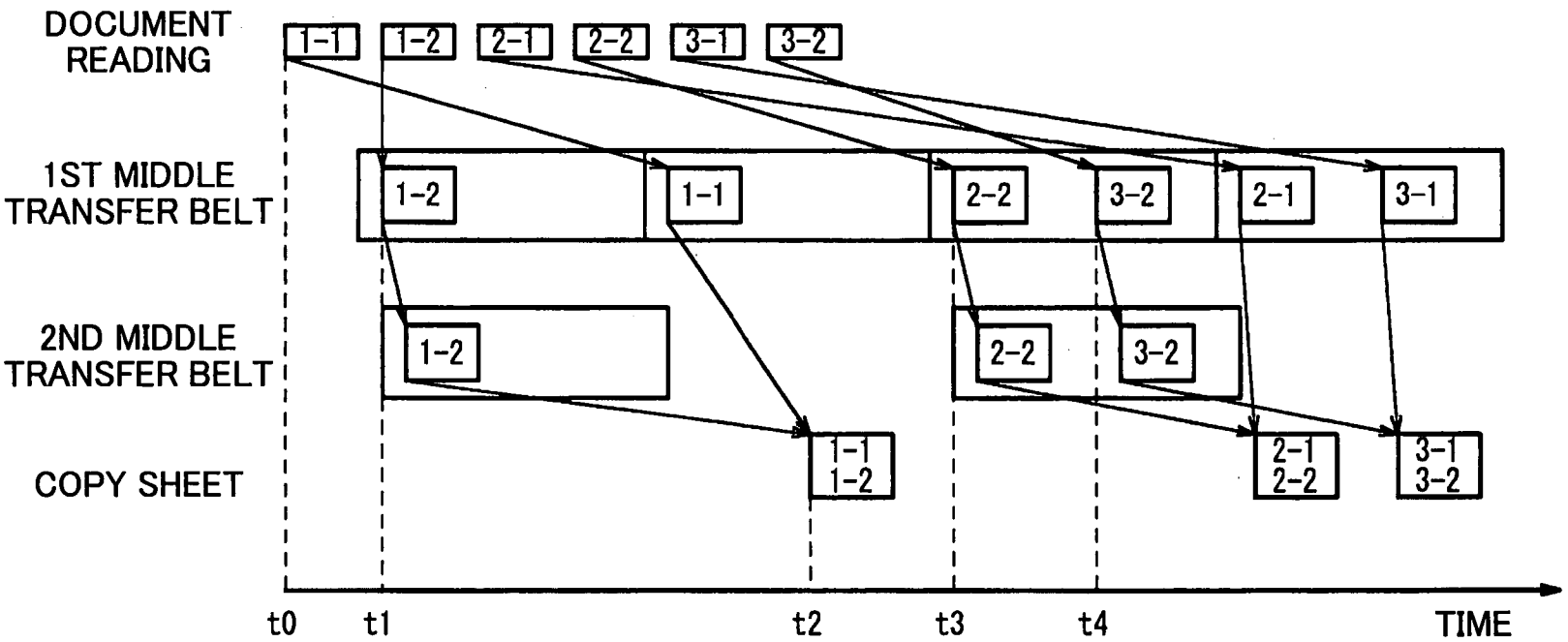
FIG. 2 is a time chart for explaining a condition in which a printing delay arises at the initial stage of double-sided printing.

FIG. 2 is a time chart for explaining a condition in which a printing delay arises at the early stage of double-sided image formation.

In FIG. 2, the timing of document reading, the timing of imaging/transferring of an image to the first middle transfer belt 10, the timing of imaging/transferring of an image to the second middle transfer belt 100, and the timing of printing of images on the copy sheet, each according to the passage of time, are shown by setting the time-axis as the horizontal axis.

For the sake of convenience of description, in the following description, the front-side image of the first sheet and the back-side image of the first sheet are designated by page numbers 1-1 and 1-2, respectively, and the front-side image of the second sheet and the back-side image of the second sheet are designated by page numbers 2-1 and 2-2, respectively.

Usually, the actual composition of the digital copier is provided such that the reading of the document reader is quicker than the printing of the printing device. Thus, at the time the printing of the first-page image is performed, the reading of the second-page image is carried out. When such condition of the digital copier proceeds further, the quantity of the image data of the document images accumulated in the image memory is further increased. In other words, the printing operation does not catch up with the reading operation.

Hence, as shown in FIG. 2, the reading of the image of page 2-2 is not yet finished when starting the imaging and transferring of the image of page 1-1, and when starting the imaging and transferring of the image of page 2-2, the reading of the image of page 3-2 is already completed.

In the example of FIG. 2, starting from the time to, the reading of document images is sequentially performed in order of pages, such as the front-side image (1-1) and the back-side image (1-2) of the first sheet, and then the front-side image (2-1) and the back-side image (2-2) of the second sheet. The read image data of the document images are accumulated in the image accumulation device (or the image memory).

To avoid reversing of the pages of the printed copy sheets stacked on the ejection stack section 40, the document image of page 1-2 is first read from the image memory at the time t1, and it is transferred to the first middle transfer belt 10 after the imaging on the photoconductor drum 1, then transferred to the second middle transfer belt 100.

The document image of page 1-1 is read and formed on the photoconductor drum 1, during the movement of the transferred image of page 1-2 with the second middle transfer belt 100, and the image of page 1-1 is transferred to the first middle transfer belt 10. At the time t2, the transferred images of page 1-1 and 1-2 are simultaneously transferred to the front and back sides of the copy sheet P, respectively.

In the meantime, the reading operation continues, and when starting the imaging and transferring of the image of the second sheet at the time t3, the reading and accumulation of the image of page 3-2 is completed.

In order to reduce the double-sided image formation time as a whole, the first middle transfer belt 10 and the second middle transfer belt 100 are capable of supporting a plurality of document images (in this case, two images) thereon according to the specified document size. At the time t4, after the image of page 2-2 is transferred to the first middle transfer belt 10, the image of page 3-2 is also transferred to the first middle transfer belt 10 at the position immediately after the transferred image of page 2-2. And the images of page 2-2 and page 3-2 are transferred to the second middle transfer belt 100. In the meantime, the images of page 2-1 and page 3-1 are transferred to the first middle transfer belt 10.

Therefore, the images of page 2-1 and page 2-2 and the images of page 3-1 and page 3-2 are continuously transferred to the front and back sides of the second copy sheet and the front and back sides of the third copy sheet, respectively. In this manner, the double-sided continuous transferring of images to the second and third sheets can be performed, and, the double-sided continuation transferring operation will be performed for the subsequent pages.

The above-described printing operation is realized by the CPU 61 of the control unit 60 which functions as a detection unit to detect the number of the back-side toner images which can be supported by the second middle transfer belt 100, and a determination unit to determine whether the reading of all the back-side images in the detected number of the images is completed.

Figure 3:
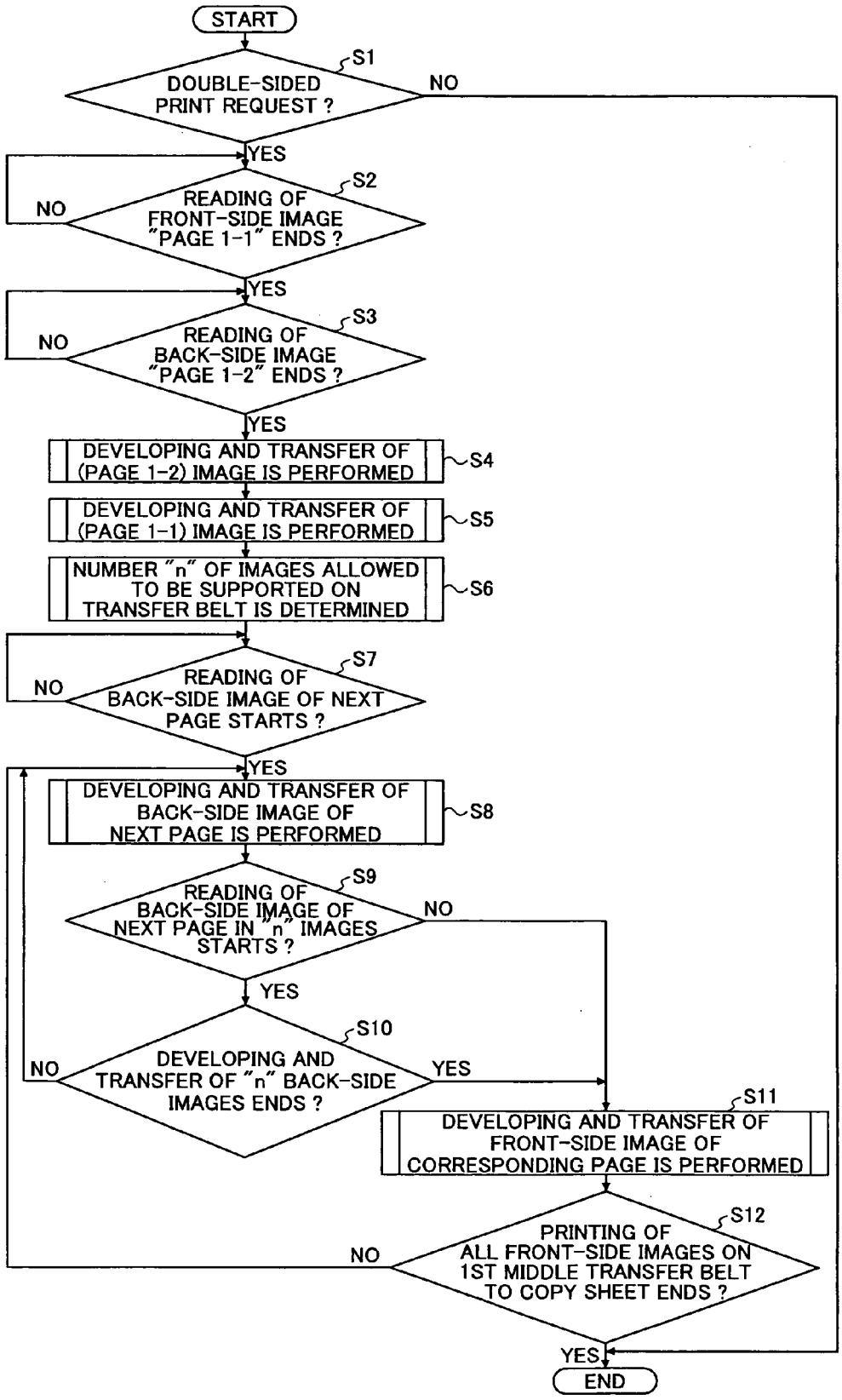
FIG. 3 is a flowchart for explaining a first preferred embodiment of the double-sided image forming method of the invention.

FIG. 3 is a flowchart for explaining the first preferred embodiment of the double-sided image-formation method of the invention which is carried out by the double-side digital copier of FIG. 1.

As shown in FIG. 3, when the power supply of the double-side digital copier is switched on, the CPU 61 of the control unit 60 starts the procedure of the double-sided image-formation. The CPU 61 determines whether a double-sided printing request is inputted by the user from the copier operation panel (not shown) (S1).

When the double-sided printing request is not inputted at the step S1, the procedure of FIG. 3 is finished.

When the double-sided printing request is inputted at the step S1, the CPU 61 determines whether the end of the reading of the front-side image of page 1-1 is detected according to an output signal of the reading end sensing unit (not shown) (S2).

When the reading of the image of page 1-1 is not completed at the step S2, the CPU 61 waits for the reading end. When the reading end is detected, the CPU 61 determines whether the end of the reading of the image of page 1-2 is detected according to an output signal of the reading end sensing unit (S3).

When the reading of the image of page 1-2 is not completed at the step S3, the CPU 61 waits for the reading end. When the reading end is detected, the CPU 61 causes the digital copier to perform the developing (imaging) of the image of page 1-2 on the photoconductor drum 1, the transferring of the toner image to the first middle transfer belt 10, and the transferring of the toner image to the second middle transfer belt 100 from the first middle transfer belt 10 (S4). For the sake of convenience, these printing operations of the digital copier, hereinafter, will be called the imaging/transfer operation.

When the step S4 is performed, the CPU 61 causes the digital copier to perform the imaging of the image of page 1-1 on the photoconductor drum 1 and the transferring of the toner image to the first middle transfer belt 10 (the imaging/transfer operation) (S5).

In the step S5, the front-side image (1-1) transferred to the first middle transfer belt 10 and the back-side image (1-2) transferred to the second middle transfer belt 100 are simultaneously transferred to the front and back sides of the first copy sheet. And the printing operation for the copy sheet is automatically performed. Namely, the toner is fixed to the copy sheet and the copy sheet with the double-sided printed images is delivered to the ejection stack section 40 automatically.

When the step S5 is performed, the CPU 61 determines the number "n" of toner images which can be supported on the first middle transfer belt 10 or the second middle transfer belt 100, according to the specified document size (S6).

The determination of "n" is performed by the CPU 61 based on the specified document size which is inputted by the user from the copier operation panel (not shown).

When the step S6 is completed, the CPU 61 determines whether the start of the reading of a back-side image of the following page is detected according to an output signal of the reading start sensing unit (not shown) (S7).

When the reading of the image of the next page is not started at the step S7, the CPU 61 waits for the reading start. When the reading start is detected, the CPU 61 causes the digital copier to perform the imaging/transfer operation of the back-side image of the following page (S8).

When the step S8 is performed, the CPU 61 determines whether the reading of a back-side image of the next page in the "n" images is started (S9). When the reading is not started at the step S9, the CPU 61 causes the digital copier to perform the imaging/transfer operation of a corresponding front-side image (S11).

When the reading of the back-side image of the next page in the "n" images is started at the step S9, the CPU 61 determines whether the imaging/transfer operation of the "n" back-side images is finished (S10).

When the imaging/transfer operation of the step S10 is not finished, the CPU 61 waits for the end of the imaging/transfer operation of the "n" back-side images, and the control of the CPU 61 is returned to the above step S8.

When the end of the imaging/transfer operation of the "n" back-side images is detected at the step S10, the CPU 61 performs the step S11 in which the imaging/transfer operation of a corresponding front-side image is performed.

When the step S11 is performed, the CPU 61 determines whether the printing operation of all the images transferred to the first middle transfer belt 10 is finished (S12).

When the printing operation is not finished, the CPU 61 waits for the end of the printing operation. The control of the CPU 61 is returned to the above step S8 in which the imaging/transfer operation of the back-side image of the following page is performed.

When the end of the printing operation is detected at the step S12, the CPU 61 finishes the double-sided image-formation procedure of FIG. 3.

The double-sided image formation procedure of the above-described embodiment is applied to the digital copier in which the reading operation of the images is faster than the printing operation and the second middle transfer belt 100 is capable of supporting the number "n" of toner images thereon. The imaging/transfer operation of the front-side and back-side images of the first copy sheet is first performed preferentially. After that, when performing the imaging/transfer operation of the back-side images of the following sheets, it is determined whether the reading of the back-side image of the next page in the "n" images is started. When the reading of the back-side image (for example, the image of page 3-2) is not started, the imaging/transfer operation of a corresponding front-side image (for example, the image of page 2-1) is performed. When the reading of the back-side image is started, the imaging/transfer operation of the back-side image of the following page (for example, the image of page 3-2) is performed.

Therefore, it is possible for the present embodiment to quickly enter the double-sided continuation printing of the plural copy sheets at the early stage after the printing start, and the time of the double-sided image formation as a whole can be minimized.

In the above-mentioned embodiment, the double-sided continuation printing of the plural copy sheets can be started as early as possible at the initial stage after the printing start. However, the occurrence of a paper jam at the early stage of the printing operation will delay the start of the double-sided continuation printing.

To obviate this problem, in the double-sided image forming apparatus of the second preferred embodiment of the invention, the known paper jam detection device is provided in the digital copier, and the CPU 61 of the control unit 60 determines whether a paper jam takes place in the digital copier after the end of the reading of the back-side image (page 1-2) and during the imaging/transfer operation of the back-side image (page 1-2) in the middle of the double-sided continuation printing procedure of FIG. 3.

Figure 4:
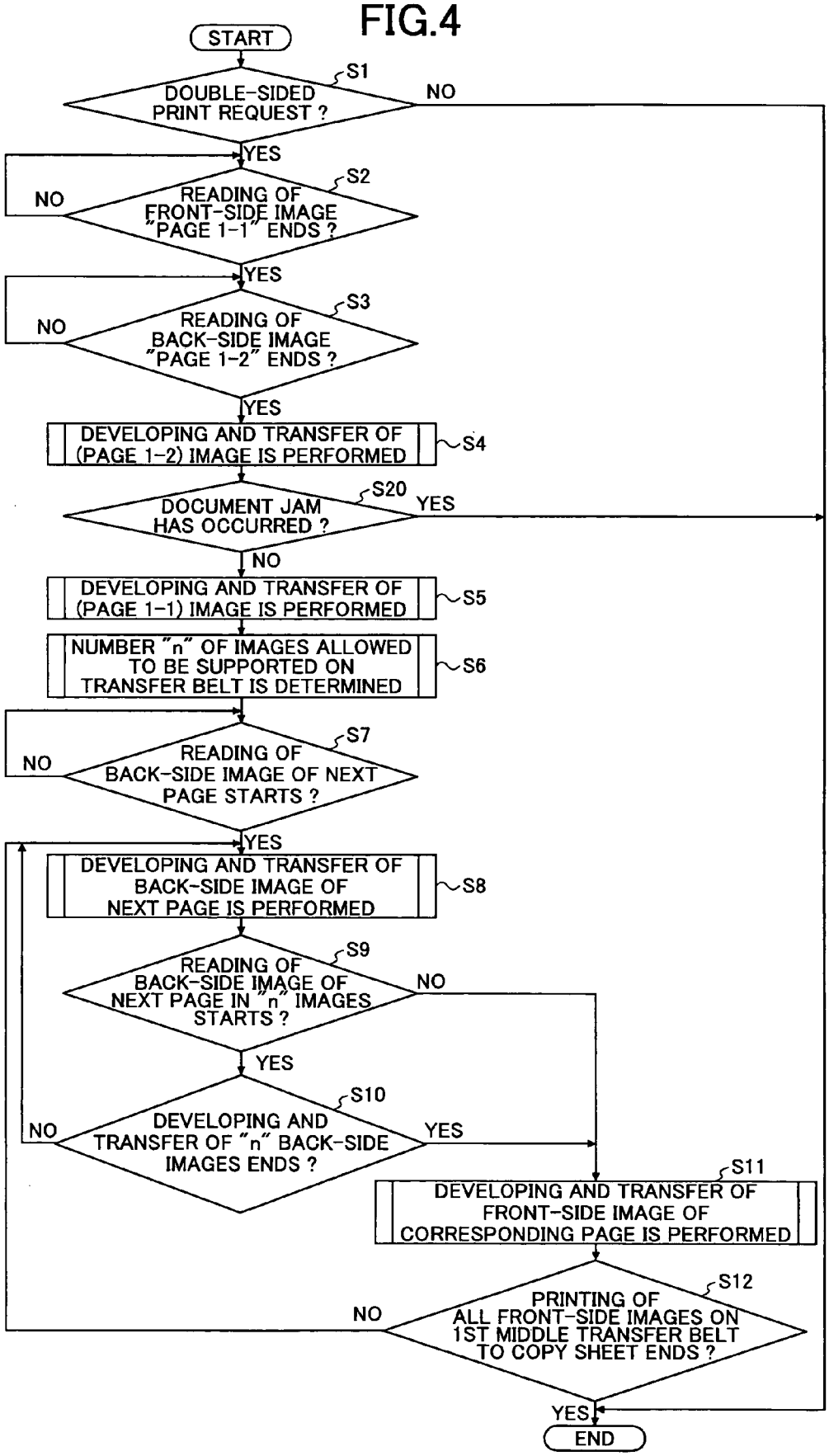
FIG. 4 is a flowchart for explaining a second preferred embodiment of the double-sided image forming method of the invention.

FIG. 4 is a flowchart for explaining the second preferred embodiment of the double-sided image forming method of the invention in which the occurrence of a paper jam at the early stage of the double-sided image formation is determined in order to start the double-sided continuation printing as early as possible.

In FIG. 4, the steps which are essentially the same as corresponding steps in the flowchart of FIG. 3 are designated by the same reference numerals, and a description thereof will be omitted.

In the procedure of double-sided continuation printing of FIG. 4, after the imaging/transfer operation of the back-side image of page 1-2 is performed at the step S4 and before the imaging/transfer operation of the image of page 1-1 is performed at the step S5, the CPU 61 determines the occurrence of a paper jam by using the paper jam detection device (not shown) (S20).

When the occurrence of a paper jam is detected at the step S20, the CPU 61 finishes the procedure of FIG. 4, waiting for the removal of the cause of such a paper jam.

When there is no paper jam, the CPU 61 performs the imaging/transfer operation of the image of page 1-1 at the step S5.

According to the present embodiment, the occurrence of a paper jam is detected during the imaging/transfer operation of the front-side and back-side images of the first copy sheet. When the occurrence of a paper jam is detected, the double-sided continuation printing procedure is temporarily terminated and the paper jam is eliminated. After that, the double-sided continuation printing procedure is restarted from the beginning of the procedure.

Therefore, the printing delay at the early stage of the double-sided image formation can be prevented by the detection of a possible trouble, and it is possible to minimize the double-sided printing time as a whole (the first copy time) needed to start the double-sided continuation printing procedure.

In the above-mentioned embodiment, the ADF (automatic document feeder) is used to perform the document reading automatically. However, depending on the convenience of the printing layout, the user may set original documents one by one on the contact glass (document stand) of the digital copier manually in order to obtain a double-sided copy.

In another preferred embodiment of the double-sided image forming apparatus of the invention, the stop mode (or the ADF stop mode) is provided, and the imaging/transfer operation of a front-side image and a back-side image for each copy sheet is performed, in order to minimize the time of the double-sided image formation as a whole.

Figure 5:
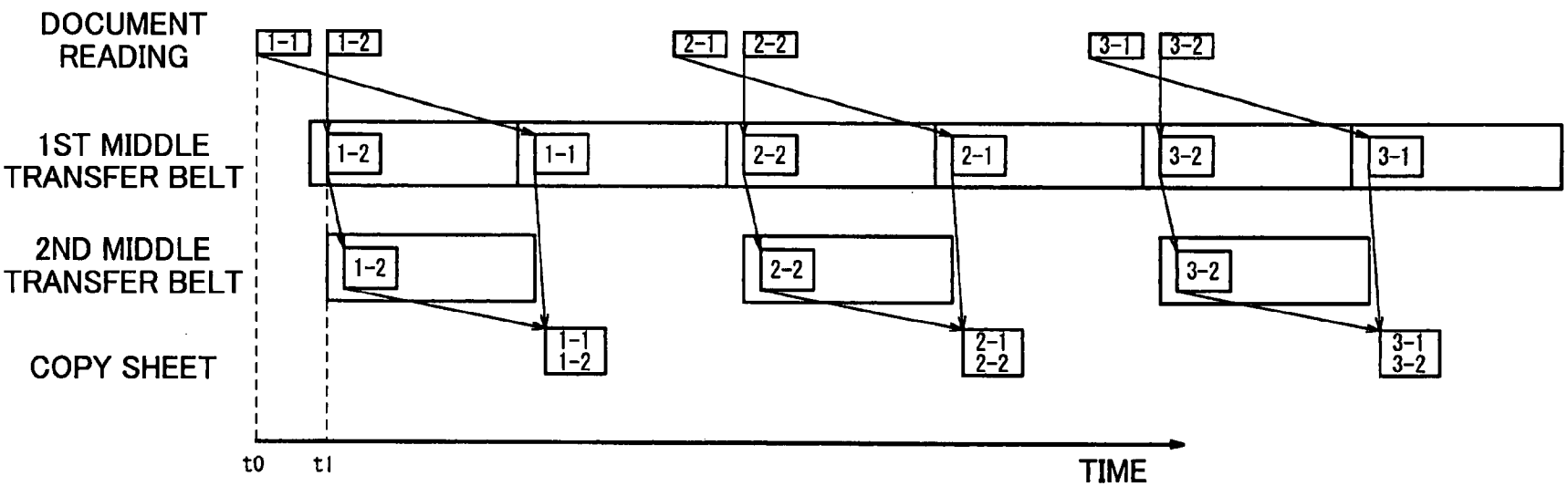
FIG. 5 is a time chart for explaining a condition in which a printing delay arises when a manual document reading is performed with double-sided printing.

FIG. 5 is a time chart for explaining the condition in which the printing delay arises at the initial stage of printing when the original documents are manually set on the contact glass of the digital copier one by one and the double-sided printing is performed.

As shown in FIG. 5, the document reading is performed in order of pages of the original documents, and the speed of the reading of the document images is slow due to the manual setting of the documents. The start of the reading of the back-side image (3-2) of the third copy sheet is not early enough for the start of the imaging/transfer operation of the back-side image (3-2) to the first middle transfer belt 10.

For this reason, the double-sided printing operation is intermittently performed for each copy sheet, and the time of the completion of the three double-sided copies becomes late. Thus, when the start of the reading of a corresponding back-side image is not early enough for the start of the imaging/transfer operation of the corresponding back-side image to the first middle transfer belt 10, it is impossible to start the double-sided continuation printing operation.

In order to avoid the above problem, an ADF stop mode is provided for use when setting manually the original documents one by one on the contact glass of the copier to perform the document reading. The CPU 61 of the control unit 60 automatically detects the setting of the stop mode, and performs a special printing operation for the stop mode. In this special printing operation, the CPU 61 performs the imaging operation of the front-side image (for example, the image (2-1)) of a preceding copy sheet on the first middle transfer belt 10 regardless of an end of the reading of the back-side image (for example, the image (3-2)) of a following copy sheet.

Figure 6:
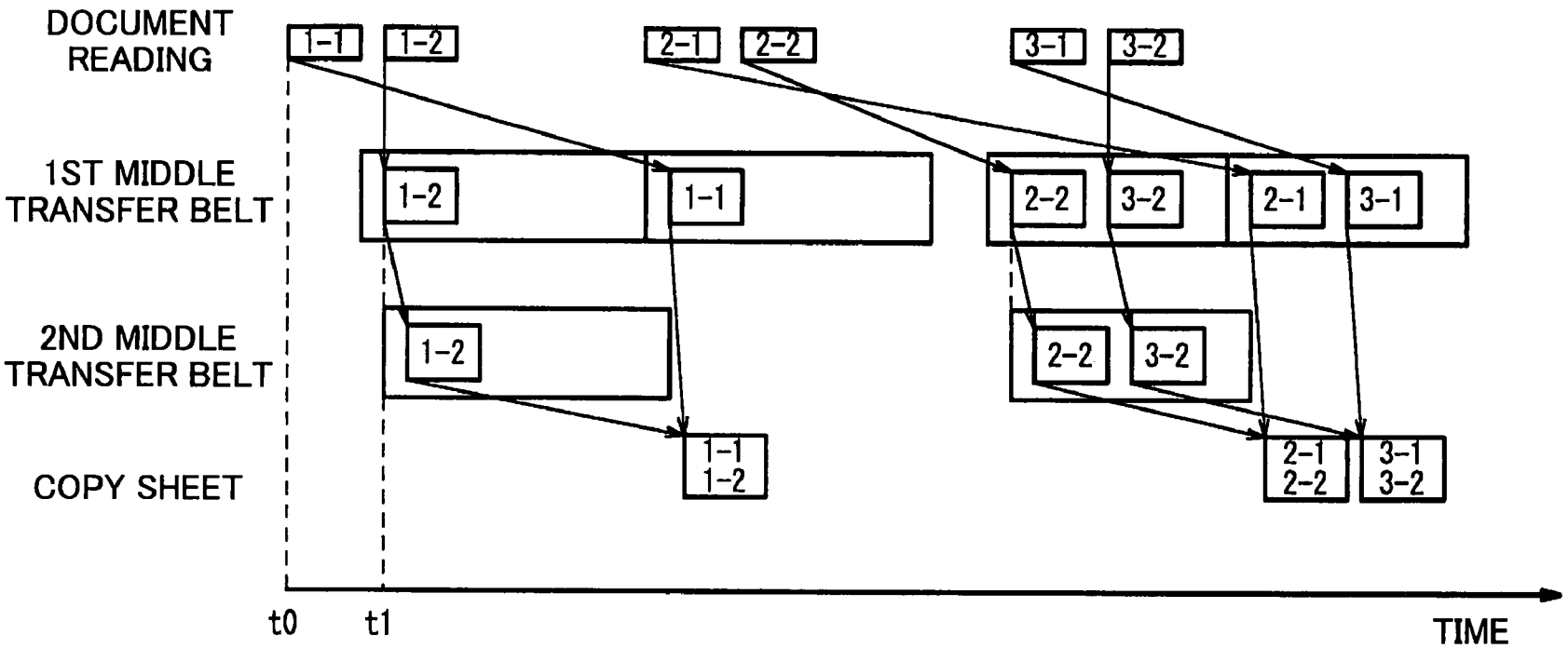
FIG. 6 is a time chart for explaining a condition in which double-sided printing is performed after the end of reading of a back-side image of next page in "n" images.

FIG. 6 is a time chart for explaining the condition in which the double-sided printing operation is performed after the end of reading of a back-side image of a following page in the "n" images.

As shown in FIG. 6, the document reading is intermittently performed at certain time intervals for each sheet of the original documents in order of the pages, such as the front-side image (1-1) and the back-side image (1-2) of the first sheet, the front-side image (2-1) and the back-side image (2-2) of the second sheet, and the front-side image (3-1) and the back-side image (3-2) of the third sheet. For this reason, the problem arises in that the document reading operation does not catch up with the imaging/transfer operation in the first middle transfer belt 10 and the second middle transfer belt 100.

In this case, the CPU 61 of the control unit 60 functions as a detection unit to detect the number of the back-side images, which can be supported by the second middle transfer belt 100, according to the specified document size.

The CPU 61 determines whether the reading of the back-side image (3-2) is started. When the reading of the back-side image (3-2) is not started, the CPU 61 controls the digital copier to stop temporarily the imaging/transfer operation of the toner images of the first middle transfer belt 10 and the second middle transfer belt 100.

Therefore, the toner images of the two sheets (page 2-2 and page 3-2) can be transferred together to the second middle transfer belt 100, and the double-sided printing of the images to the second and third copy sheets can be performed continuously. Accordingly, the printing delay of double-sided printing operation as a whole can be prevented.

Figure 7:
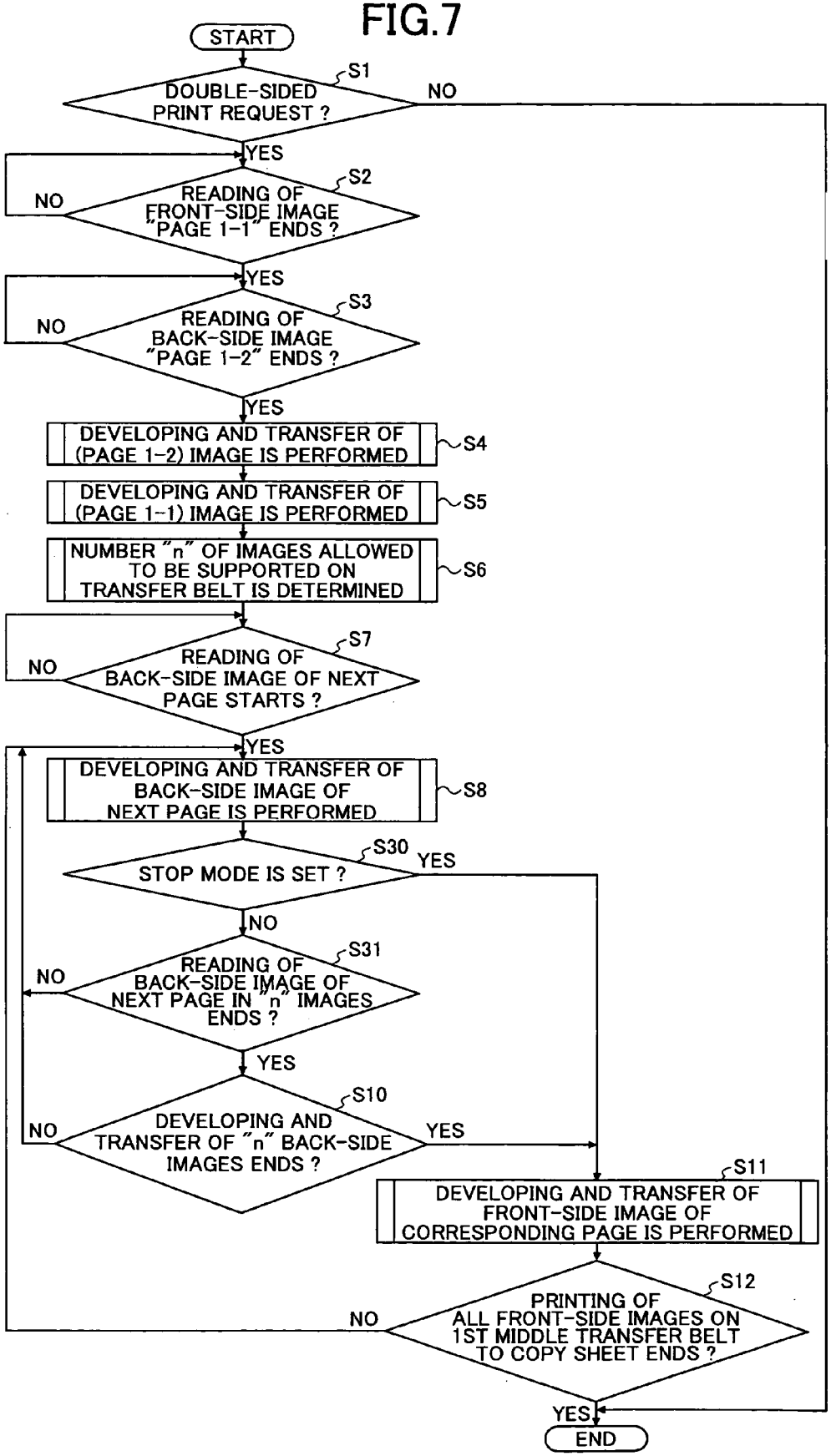
FIG. 7 is a flowchart for explaining a third preferred embodiment of the double-sided image forming method of the invention in which a stop mode is provided.

FIG. 7 is a flowchart for explaining the third preferred embodiment of the double-sided image forming method of the invention in which the stop mode is provided.

In FIG. 7, the steps which are essentially the same as corresponding steps in the flowchart of FIG. 3 are designated by the same reference numerals, and a duplicate description thereof will be omitted.

In the procedure of double-sided printing of FIG. 7, when the imaging/transfer operation of the back-side image of a following page is performed at the step S8, the CPU 61 determines whether the stop mode is set (S30).

When the setting of the stop mode is not detected at the step S30, the CPU 61 determines whether the reading of the back-side image of the next page in the "n" images (in this example, 2 images) is finished (S31).

When the reading is finished at the step S31, the CPU 61 determines whether the imaging/transfer operation of the "n" back-side images is finished (S10).

When the reading is not finished at the step S31, the CPU 61 stops temporarily the imaging/transfer operation of the first middle transfer belt 10 and the second middle transfer belt 100 until the reading of the back-side image (for example, the image of page 3-2) of the next page in the "n" images is completed. The control of the CPU 61 is returned to the step S8, and then the CPU 61 determines at the step S30 whether the stop mode is set.

The other steps of the procedure of the present embodiment are essentially the same as those corresponding steps in the flowchart of FIG. 3, and a description thereof will be omitted.

When the setting of the stop mode is detected at the step S30, the CPU 61 performs the procedure following the step S11 as in the flowchart of FIG. 3, without waiting for an end of the reading of the back-side image of the next page in the "n" images.

According to the present embodiment, when the stop mode is set, the CPU 61 does not wait for the end of reading of the back-side image (for example, the image of page 3-2) of the next page in the "n" images, and performs the imaging/transfer operation of the front-side image of a corresponding copy sheet. Thus, the present embodiment can perform the double-sided printing as early as possible, which will relieve the user who manually sets the documents on the contact glass one by one.

In the above-mentioned procedure of FIG. 7, a description of taking measures against the occurrence of a paper jam at the early stage of printing operation has been omitted. Another embodiment of the procedure of FIG. 7 may be made according to the present invention. In such modified embodiment, after the imaging/transfer operation of the back-side image of page 1-2 is performed at the step S4 and before the imaging/transfer operation of the front-side image of page 1-1 is performed at the step S5, the CPU 61 determines the occurrence of a paper jam by using the paper jam detection device.

When the occurrence of a paper jam is detected, the CPU 61 finishes the procedure of FIG. 7, waiting for the removal of the cause of such a paper jam. When there is no paper jam, the CPU 61 performs the imaging/transfer operation of the front-side image of page 1-1 at the step S5.

According to the modified embodiment, the occurrence of a paper jam is detected during the imaging/transfer operation of the front-side and back-side images of the first copy sheet. When the occurrence of a paper jam is detected, the double-sided continuation printing procedure is temporarily terminated and the paper jam will be eliminated. After that, the double-sided continuation printing procedure is restarted from the beginning of the procedure.

Therefore, the printing delay at the early stage of the double-sided image formation can be prevented by the detection of a possible trouble, and it is possible to minimize the double-sided printing time as a whole (the first copy time) needed to start the double-sided continuation printing procedure.

The present invention is not limited to the above-described embodiments, and variations and modifications may be made without departing from the scope of the present invention.

Further, the present application is based on Japanese priority application No. 2002-380918, filed on Dec. 27, 2002, and Japanese priority application No. 2003-410512, filed on Dec. 9, 2003, the entire contents of which are hereby incorporated by reference.

What is claimed is:

1. A double-sided image forming apparatus which forms a first image supported by a first image supporting medium and a second image supported by a second image supporting medium on both sides of a copy sheet simultaneously, comprising:

a first unit performing developing of the first image and the second image on the first image supporting medium;

a second unit performing transferring of the developed second image to the second image supporting medium;

a third unit controlling the developing of the second image on the first image supporting medium to be performed earlier than the developing of the first image on the first image supporting medium;

a paper jam detection device detecting a paper jam which occurs in the image forming apparatus; and a determination unit determining whether the occurrence of a paper jam is detected by the paper jam detection device, the determination being performed after an end of the developing of the second image on the first image supporting medium and before a start of the developing of the first image on the first image supporting medium.

2. The double-sided image forming apparatus of claim 1 wherein each of the first image and the second image is composed of a plurality of document images.

3. The double-sided image forming apparatus of claim 2 further comprising:

a detection unit detecting the number of document images which can be supported at a time by the second image supporting medium; and a control unit controlling the developing of the number of document images, constituting the second image, on the first image supporting medium to be performed earlier than the developing of the number of document images, constituting the first image, on the first image supporting medium.

4. The double-sided image forming apparatus of claim 3, wherein said control unit is a first control unit, said double-sided image forming apparatus further comprising a second control unit stopping the transferring of the second image to the second image supporting medium until the developing of all the number of document images, constituting the second image, on the first image supporting medium is finished.

5. A double-sided image forming apparatus which forms a first image supported by a first image supporting medium and a second image supported by a second image supporting medium on both sides of each of a plurality of copy sheets by reading the first image and the second image from a plurality of documents sequentially, comprising:

a first unit performing developing of the first image and the second image on the first image supporting medium;

a second unit performing transferring of the developed second image from the first image supporting medium to the second image supporting medium;

a third unit performing continuously double-sided image formation for second and subsequent copy sheets among the plurality of copy sheets in which the developed first image of the first image supporting medium and the developed second image of the second image supporting medium are transferred to both sides of each copy sheet after a start of the reading of the second image of a following copy sheet; and a fourth unit performing, only for a first copy sheet, the double-sided image formation earlier than the start of the reading of the second image of a following copy sheet.

6. The double-sided image forming apparatus of claim 5 further comprising:

a determination unit determining, for the second and subsequent copy sheets, whether the reading of the second image of a following copy sheet is started; and a control unit performing the developing of the first image of a corresponding copy sheet on the first image supporting medium when said reading is not started, and performing the developing of the second image of said following copy sheet on the first image supporting medium when said reading is started.

7. The double-sided image forming apparatus of claim 5 further comprising a determination unit determining, after an end of the developing of the second image of the first copy sheet on the first image supporting medium and before a start of the developing of the first image of the first copy sheet on the first image supporting medium, whether occurrence of a paper jam in the image forming apparatus is detected by a paper jam detection device.

8. The double-sided image forming apparatus of claim 5 further comprising:

a detection unit detecting the number of document images, constituting the second image, which can be supported at a time by the second image supporting medium; and a control unit controlling the developing of the number of document images, constituting the second image, on the first image supporting medium to be performed earlier than the developing of the number of document images, constituting the first image, on the first image supporting medium.

9. The double-sided image forming apparatus of claim 5 further comprising:

a determination unit determining whether a stop mode is set in the image forming apparatus; and a control unit performing, when the stop mode is set, the developing of the first image of a copy sheet on the first image supporting medium regardless of an end of the reading of the second image of a following copy sheet.

10. A double-sided image forming method which forms a first image supported by a first image supporting medium and a second image supported by a second image supporting medium on both sides of a copy sheet simultaneously in an image forming apparatus, the method comprising:

developing the first image and the second image on the first image supporting medium;

transferring the developed second image to the second image supporting medium;

controlling the developing of the second image on the first image supporting medium to be performed earlier than the developing of the first image on the first image supporting medium, detecting a paper jam which occurs in the image forming apparatus by a paper jam detection device; and determining whether the occurrence of a paper jam is detected by the paper jam detection device, the determination being performed after an end of the developing of the second image on the first image supporting medium and before a start of the developing of the first image on the first image supporting medium.

11. The double-sided image forming method of claim 10 wherein each of the first image and the second image is composed of a plurality of document images.

12. The double-sided image forming method of claim 11 further comprising:

detecting the number of document images which can be supported at a time by the second image supporting medium; and controlling the developing of the number of document images, constituting the second image, on the first image supporting medium to be performed earlier than the developing of the number of document images, constituting the first image, on the first image supporting medium.

13. The double-sided image forming method of claim 12 further comprising stopping the transferring of the second image to the second image supporting medium until the developing of all the number of document images, constituting the second image, on the first image supporting medium is finished.

14. A double-sided image forming method which forms a first image supported by a first image supporting medium and a second image supported by a second image supporting medium on both sides of each of a plurality of copy sheets in an image forming apparatus by reading the first image and the second image from a plurality of documents sequentially, the method comprising:

developing the first image and the second image on the first image supporting medium;

transferring the developed second image from the first image supporting medium to the second image supporting medium;

performing continuously double-sided image formation for second and subsequent copy sheets among the plurality of copy sheets in which the developed first image of the first image supporting medium and the developed second image of the second image supporting medium are transferred to both sides of each copy sheet after a start of the reading of the second image of a following copy sheet; and performing, only for a first copy sheet, the double-sided image formation earlier than the start of the reading of the second image of a following copy sheet.

15. The double-sided image forming method of claim 14 further comprising:

determining, for the second and subsequent copy sheets, whether the reading of the second image of a following copy sheet is started; and performing the developing of the first image of a corresponding copy sheet on the first image supporting medium when said reading is not started, and performing the developing of the second image of said following copy sheet on the first image supporting medium when said reading is started.

16. The double-sided image forming method of claim 14 further comprising determining, after an end of the developing of the second image of the first copy sheet on the first image supporting medium and before a start of the developing of the first image of the first copy sheet on the first image supporting medium, whether occurrence of a paper jam in the image forming apparatus is detected by a paper jam detection device.

17. The double-sided image forming method of claim 14 further comprising:

detecting the number of document images, constituting the second image, which can be supported at a time by the second image supporting medium; and controlling the developing of the number of document images, constituting the second image, on the first image supporting medium to be performed earlier than the developing of the number of document images, constituting the first image, on the first image supporting medium.

18. The double-sided image forming method of claim 14 further comprising:

determining whether a stop mode is set in the image forming apparatus; and performing, when the stop mode is set, the developing of the first image of a copy sheet on the first image supporting medium regardless of an end of the reading of the second image of a following copy sheet.

* * * * *